US008940677B2

(12) United States Patent
Boutique et al.

(10) Patent No.: US 8,940,677 B2
(45) Date of Patent: Jan. 27, 2015

(54) COMPACT FLUID LAUNDRY DETERGENT COMPOSITION

(75) Inventors: Jean-Pol Boutique, Gembloux (BE); Frederik Vandenberghe, Gentbrugge (BE); Myriam Bouilliche, Strombeek-Bever Grimbergen (BE); James Charles Theophile Roger Burckett-St. Laurent, Brussels (BE)

(73) Assignee: The Procter & Gamble Company, Cincinnati, OH (US)

( * ) Notice: Subject to any disclaimer, the term of this patent is extended or adjusted under 35 U.S.C. 154(b) by 115 days.

(21) Appl. No.: 12/881,365

(22) Filed: Sep. 14, 2010

(65) Prior Publication Data

US 2011/0061174 A1 Mar. 17, 2011

Related U.S. Application Data

(60) Provisional application No. 61/242,140, filed on Sep. 14, 2009.

(51) Int. Cl.

| | |
|---|---|
| ***C11D 11/00*** | (2006.01) |
| ***C11D 3/37*** | (2006.01) |
| ***C11D 3/386*** | (2006.01) |
| ***C11D 3/40*** | (2006.01) |
| ***C11D 3/42*** | (2006.01) |
| ***C11D 3/30*** | (2006.01) |
| ***C11D 1/83*** | (2006.01) |
| ***C11D 3/20*** | (2006.01) |
| ***C11D 3/43*** | (2006.01) |
| ***C11D 17/00*** | (2006.01) |
| ***C11D 17/04*** | (2006.01) |
| *C11D 1/29* | (2006.01) |

(52) U.S. Cl.

CPC ..... *C11D 1/83* (2013.01); *C11D 3/2086* (2013.01); *C11D 3/2093* (2013.01); *C11D 3/30* (2013.01); *C11D 3/386* (2013.01); *C11D 3/40* (2013.01); *C11D 3/42* (2013.01); *C11D 3/43* (2013.01); *C11D 17/0026* (2013.01); *C11D 3/3723* (2013.01); *C11D 17/046* (2013.01); *C11D 1/29* (2013.01)

USPC ..... 510/276; 510/293; 510/336; 510/337; 510/340; 510/342; 510/403; 510/406; 510/427; 510/432; 510/475

(58) Field of Classification Search

CPC .. C11D 11/0094; C11D 17/0026; C11D 3/37; C11D 3/3723; C11D 3/2086; C11D 3/30; C11D 3/386; C11D 3/40; C11D 3/42

USPC ..... 510/276, 293, 336, 337, 340, 403, 406, 510/427, 432, 475, 342

See application file for complete search history.

(56) References Cited

U.S. PATENT DOCUMENTS

| | | | | |
|---|---|---|---|---|
| 5,340,390 | A | 8/1994 | Magauran et al. | |
| 6,306,817 | B1 | 10/2001 | Kott et al. | |
| 6,514,926 | B1 | 2/2003 | Kott et al. | |
| 6,579,839 | B2 | 6/2003 | Price et al. | |
| 6,583,096 | B1 | 6/2003 | Knott et al. | |
| 6,589,927 | B1 | 7/2003 | Knott et al. | |
| 6,593,285 | B1 | 7/2003 | Scheibel et al. | |
| 6,602,840 | B1 | 8/2003 | Scheibel et al. | |
| 6,815,410 | B2 | 11/2004 | Boutique et al. | |
| 6,833,344 | B2 * | 12/2004 | Boutique et al. | 510/330 |
| 6,849,588 | B2 | 2/2005 | Elsik et al. | |
| 6,881,713 | B2 | 4/2005 | Sommerville-Roberts | |
| 6,903,061 | B2 * | 6/2005 | Masschelein et al. | 510/330 |
| 7,125,828 | B2 | 10/2006 | Catlin et al. | |
| 7,479,475 | B2 * | 1/2009 | de Buzzaccarini et al. | 510/293 |
| 7,563,757 | B2 | 7/2009 | Kouvroukoglou et al. | |
| 7,910,535 | B2 | 3/2011 | Panandiker et al. | |
| 2003/0096726 | A1 | 5/2003 | Smith et al. | |
| 2003/0199414 | A1 * | 10/2003 | Boutique et al. | 510/293 |
| 2004/0009882 | A1 | 1/2004 | Elsik et al. | |
| 2004/0058845 | A1 * | 3/2004 | Metrot et al. | 510/466 |
| 2004/0200005 | A1 | 10/2004 | Smerznak et al. | |
| 2004/0226106 | A1 | 11/2004 | Gardner et al. | |
| 2005/0043200 | A1 * | 2/2005 | Barry et al. | 510/421 |
| 2006/0003913 | A1 * | 1/2006 | Boutique et al. | 510/392 |
| 2006/0189507 | A1 * | 8/2006 | Metrot et al. | 510/515 |
| 2006/0205631 | A1 * | 9/2006 | Smerznak et al. | 510/515 |
| 2006/0275566 | A1 * | 12/2006 | de Buzzaccarini et al. | 428/35.2 |
| 2006/0276364 | A1 * | 12/2006 | Kouvroukoglou et al. | 510/293 |

(Continued)

FOREIGN PATENT DOCUMENTS

| | | | |
|---|---|---|---|
| WO | WO 2005/118430 | A1 | 12/2005 |
| WO | WO 2007/130562 | A2 | 11/2007 |

(Continued)

OTHER PUBLICATIONS

EP Search Report Dtd Oct. 6, 2014; 8 Pages; EP 10816263.7 (PCT/US2010048742).

(Continued)

*Primary Examiner* — Lorna M Douyon

(74) *Attorney, Agent, or Firm* — Gregory S. Darley-Emerson; Steven W. Miller

(57) ABSTRACT

Compact liquid or gel-form laundry detergent compositions processes for manufacturing such compositions, wherein the compositions comprise at least a stabilization system against phase splitting having an alkanolamine and a coupling polymer component and preferably a stabilization system against phase splitting having an alkanolamine, a coupling polymer and a crystalline structurant component.

13 Claims, No Drawings

(56) References Cited

U.S. PATENT DOCUMENTS

| | | | | |
|---|---|---|---|---|
| 2008/0004200 | A1* | 1/2008 | Boutique et al. | 510/393 |
| 2008/0032909 | A1* | 2/2008 | de Buzzaccarini et al. | 510/293 |
| 2009/0124528 | A1* | 5/2009 | Danziger et al. | 510/224 |
| 2009/0176682 | A1 | 7/2009 | Boutique et al. | |
| 2009/0298739 | A1 | 12/2009 | Courchay et al. | |
| 2010/0240569 | A1* | 9/2010 | Boutique et al. | 510/299 |
| 2010/0240571 | A1* | 9/2010 | Boutique et al. | 510/338 |
| 2010/0249003 | A1 | 9/2010 | Doi et al. | |
| 2011/0065624 | A1 | 3/2011 | Boutique et al. | |
| 2011/0065625 | A1 | 3/2011 | Boutique et al. | |
| 2011/0312869 | A1* | 12/2011 | Danziger et al. | 510/357 |

FOREIGN PATENT DOCUMENTS

| | | | |
|---|---|---|---|
| WO | WO 2008/055121 | A2 | 5/2008 |
| WO | WO 2009/061990 | A1 | 5/2009 |
| WO | WO 2009/071709 | A1 | 6/2009 |

OTHER PUBLICATIONS

U.S. Appl. No. 12/881,276, filed Sep. 14, 2010, Boutique, et al.

* cited by examiner

COMPACT FLUID LAUNDRY DETERGENT COMPOSITION

CROSS-REFERENCE TO RELATED APPLICATIONS

This application claims priority under 35 USC §119(e) to U.S. Provisional Application Ser. No. 61/242,140, filed Sep. 14, 2009.

FIELD OF THE INVENTION

The present invention relates to compact liquid or gel-form laundry detergent compositions and to processes for manufacturing such compositions.

BACKGROUND OF THE INVENTION

Sustainability may influence consumer choice in the market place. Consequently, there is a movement toward providing products that may have a reduced impact on the environment. In the field of liquid laundry detergents, this has led to the development of new formulations that can be effective at relatively low washing temperatures. These new formulations are desirable since utilizing lower washing temperatures can save energy as well as prolong the useful life of fabrics.

In some instances, new detergent formulations are concentrated from the traditional dilute liquid form into a concentrated liquid or gel form. These so-called "compacted" detergents are also desirable since they require less packaging material, are easier to transport in bulk and occupy less space on the store shelf.

Based upon the foregoing, it would be desirable to combine both compaction of a liquid laundry detergent with superior low temperature performance. However, current compaction methods may not provide for concentrated detergents that rapidly and effectively dissolve at lower than normal wash temperatures.

Compaction of liquid laundry detergents is currently accomplished using several means. One means is by increasing surfactant concentrations and removing organic solvent. The resulting detergents may derive rheological characteristics from the surfactant and are often referred to as being "internally structured". However, internally structured liquid laundry detergents may be extremely viscous and phase unstable. Moreover, internally structured liquid laundry detergents may become even more viscous upon dissolution in a laundry bath. Thus these compacted detergents may not be particularly effective for low temperature laundering in which dissolution may be an issue even for non-compacted liquid laundry detergents. This may particularly be the case when short washing machine cycles are utilized.

Another means of compacting liquid laundry detergents is to maintain a proportion of organic solvents in the detergent while removing water. This approach is consistent with the formulation of detergent into soluble film packets. Typical water levels in such detergents are as low as from about 5 to 10% by weight so as to avoid dissolution of the soluble, e.g., PVA film during storage of the detergent. However, this formulation approach does not take into account the high cost of converting many laundry detergent ingredients, which are commercially available in a form having a large proportion of water, into dry or near-to-dry forms. In addition to the cost of removing water from these ingredients, the manufacturing processes for these concentrated detergents may need to be substantially modified so as to be able to process dry or highly viscous raw materials into the detergent.

In many geographies, there is furthermore a need to include builders in the detergent formulation for their known water-hardness management characteristics. However builders place further constraints on the ability to compact a detergent owing to their salting-out effects (in the case of citrate) or their viscosifying effects on surfactants (in the case of fatty acid builders). Yet, it is desirable to include such materials in compact laundry gel formulations.

Therefore there remains a need to provide cost-effective detergent formulations, and the associated processes for making them, that will provide both the benefits of substantial compaction of the detergent and that will achieve desired performance parameters at low temperatures, particularly via effective dissolution and in the presence of dissolved builders. In one aspect, the present invention addresses this problem without resorting to the very low water levels that are typical of some liquid detergents that are provided in a unitized dose.

In another aspect intimately related to the foregoing problems, there is an ongoing need for a process for manufacturing a concentrated aqueous liquid or gel-form laundry detergent comprising at least 10% of at least one anionic nonsoap surfactant; at least 0.1% of other surfactants (especially nonionic surfactants) such that the total surfactant level is at least 20%; and such that the detergent comprises no more than 15% organic non-aminofunctional solvent, wherein said detergent is free from phase splits.

SUMMARY OF THE INVENTION

In an embodiment, the present invention solves the technical problem of stabilizing compact liquid or gel-form laundry detergents by providing a process for manufacturing a concentrated aqueous liquid or gel-form laundry detergent comprising at least 10% of at least one anionic nonsoap surfactant; at least 0.1% of other surfactants such that the total surfactant level is at least 20%; and no more than 15% organic nonaminofunctional solvent; said process comprising in any order (i) at least one step of formulating said detergent with an alkanolamine; (ii) at least one step of formulating said detergent with a coupling polymer; and (iii) at least one step of formulating said detergent with a laundering adjunct. It is essential to add a laundering adjunct so as to ensure that the product is fully suited for use as a laundering composition—in contrast with other types of cleaning composition such as shampoos or hard surface cleaners. The laundering adjunct is any material having specific benefit effects in laundering of fabrics and is preferably selected from detergent-active enzymes, textile optical brighteners and fabric-hueing dyes. In a preferred process, said coupling polymer is at a level of from 0.1% to 5% by weight of said detergent and is selected from the group consisting of water-soluble, polar amphiphilic copolymers having an aliphatic backbone comprising at least two nitrogen atoms to which backbone are connected at least two side-chains comprising poly(ethoxylate) moieties.

In another embodiment, the process is as defined hereinabove but additionally or further comprising a step (iv) in any order with respect to steps (i), (ii) and (iii) of formulating into said detergent from 0.05% to 2% by weight of said detergent of a crystalline structurant, a suitable by by no means limiting example of which is hydrogenated castor oil.

Accordingly the invention encompasses preferred processes which formulate a laundry detergent with a three-part stabilization system comprising (a) an alkanolamine; (b) a coupling polymer and (c) a crystalline structurant.

Further, the present invention provides a laundry detergent which can be characterized as the product of the inventive process, which has a stability to phase splits defined as follows: the phase stability of the detergent is evaluated by placing 300 ml of the composition in a glass jar for 21 days at 21° C. The detergent is stable to phase splits if, within said time period, (i) it is free from splitting into two or more layers or, (ii) if said composition splits into layers, a major layer comprising at least 90%, preferably 95%, by weight of the composition is present. In preferred embodiments the detergent is free from splitting into two or more layers.

Moreover the invention provides a packaged aqueous laundry detergent composition comprising: (I) a package capable of variable dose delivery, said package preferably being equipped with a pretreating spout, (II) a label affixed with dosing instructions recommending a dose per wash in an automatic laundry washing machine of no more than 50 ml; and (III) said detergent; wherein in an embodiment, said detergent comprises by weight percentage from about 25% to about 55% total surfactant including at least an anionic non-soap surfactant and a nonionic surfactant at a ratio by weight of from 1:2 to about 100:0 and a stabilization system against phase splitting comprising: (a) alkanolamine; (b) crystalline structurant; and (c) coupling polymer; wherein said detergent has an aqueous pH at 5% in water of from 6 to 9 and said detergent has a pour viscosity of greater than about 1000 centipoises at 20 $s^{-1}$ and a low shear viscosity of greater than about 100,000 centipoises at 0.01 $s^{-1}$.

The present invention achieves surprising results. In one aspect, it is unexpected to identify a selection of nitrogen-functional coupling polymers which do not lead to a phenomenon known in the art as "associative phase separation". This well-known phenomenon would be expected to lead to destabilization, rather than stabilization of the detergent compositions. It is also surprising that the crystalline structurant contributes to stability without adversely affecting solubility of the detergent—since the structurant is crystalline and not substantially dissolved, it might have been expected that flocculation or destabilization and/or reduction in solubility, rather than stabilization of the detergent, would occur.

Moreover, as is shown in the examples hereinafter, stability as well as cleaning results of the compositions meet the required success criteria.

DETAILED DESCRIPTION OF THE INVENTION

Definitions

As used herein, "compact fluid laundry detergent composition" refers to any laundry treatment composition comprising a fluid capable of wetting and cleaning fabric e.g., clothing, in a domestic washing machine. The composition can include solids or gases in suitably subdivided form, but the overall composition excludes product forms which are non-fluid overall, such as tablets or granules. Compositions which are overall gases are also excluded. The compact fluid detergent compositions have densities in the range from about 0.9 to about 1.3 grams per cubic centimeter, more specifically from about 1.00 to about 1.10 grams per cubic centimeter, excluding any solid additives but including any bubbles, if present.

Examples of compact fluid laundry detergent compositions include heavy-duty liquid laundry detergents for use in the wash cycle of automatic washing-machines, liquid fine wash and liquid color care detergents such as those suitable for washing delicate garments, e.g., those made of silk or wool, either by hand or in the wash cycle of automatic washing-machines. The corresponding compositions having flowable yet stiffer consistency, known as gels or pastes, are likewise encompassed. The rheology of shear-thinning gels is described in more detail in the literature, see for example WO04027010A1 Unilever.

In general, the compact fluid laundry detergent compositions herein may be concentrated aqueous liquid or gel-form laundry detergent compositions. These may be isotropic or non-isotropic, however, in preferred embodiments, they are stable to phase split, i.e., they do not generally split on storage into separate layers such as phase split detergents described in the art which are designed to be homogenized by mixing (e.g., by shaking the bottle) before use. One specific illustrative composition is non-isotropic and on storage said composition is either (i) free from splitting into two layers or, (ii) if said composition splits into layers, a single major layer, water-rich with respect to other layer(s), is present and said major layer comprises at least about 80% by weight, more specifically more than about 90% by weight, even more specifically more than about 95% by weight of the composition. Other illustrative compositions are isotropic.

As used herein, when a composition and/or method are "substantially free" of a specific ingredient(s) it is meant that specifically none, or in any event no functionally useful amount, of the specific ingredient(s) is purposefully added to the composition. It is understood to one of ordinary skill in the art that trace amounts of various ingredient(s) may be present as impurities. For avoidance of doubt otherwise, "substantially free", in the context of any non-catalytic ingredient shall be taken to mean that the composition contains less than about 0.1%, specifically less than 0.01%, by weight of the composition of an indicated ingredient. In the case of catalytically active ingredients, much lower levels of ingredient can have significant technical effects, and "substantially free" shall be taken to mean that the composition is not deliberately formulated with addition of catalytically effective amounts of any such ingredient. "Catalytically effective amounts" as is known in the art can be very low, e.g., from parts per billion to parts per million levels.

As used herein, the term "crystalline structurant" refers to a selected compound or mixture of compounds which provide structure to a detergent composition independently from, or extrinsic from, any structuring effect of the detersive surfactants of the composition. Structuring benefits include arriving at yield stresses suitable for suspending particles having a wide range of sizes and densities.

By "internal structuring" it is meant that the detergent surfactants, which form a major class of laundering ingredients, are relied on for structuring effect. The present invention, in the opposite sense, aims at "external structuring" meaning structuring which relies on a nonsurfactant, e.g., crystallized glyceride(s) as structurants, including, but not limited to, hydrogenated castor oil, to achieve the desired rheology and particle suspending power.

Markush language as used herein encompasses mixtures of the individual Markush group members, unless otherwise indicated.

All percentages, ratios and proportions used herein are by weight percent of the composition, unless otherwise specified. All average values are calculated "by weight" of the composition or components thereof, unless otherwise expressly indicated.

All numerical ranges disclosed herein, are meant to encompass each individual number within the range and to encompass any combination of the disclosed upper and lower limits of the ranges.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

Preferred process embodiments of the present invention require the mixing of at least an alkanolamine and at least a coupling polymer into a specifically defined laundry detergent concentrate which contains a laundry adjunct selected from detergent active enzymes, textile optical brighteners and fabric hueing dyes. Further preferred processes require the mixing of a three component stabilization system into the detergent, where the three component stabilization system comprises a coupling polymer, an alkanolamine and a crystalline structurant.

Preferred laundry detergent composition embodiments of the present invention accordingly comprise: coupling polymer; alkanolamine; crystalline structurant, especially hydrogenated castor oil; anionic nonsoap surfactants; especially including an alkyl(polyalkoxy)sulfate; other surfactants, especially nonionic surfactants; laundering adjuncts, especially selected from detergent active enzymes, textile optical brighteners and fabric hueing dyes; multivalent water-soluble organic builder and/or chelants; organic, non-aminofunctional solvents; and water.

Other embodiments may further encompass semipolar nonionic cosurfactants such as amine oxides; perfumes including perfume microcapsules; bleaches including encapsulated bleaches; aesthetic systems including dyes, pigments, opacifiers and the like; fabric care actives etc.

Coupling Polymer

In more detail the present invention makes a narrow selection, from the vast numbers of polymers known for various uses in laundry detergents, on the basis that these selected polymers are useful for coupling the phases of the detergent so as to stabilize them against phase splitting.

Surprisingly in view of the art, a wide range of polymers such as the polyacrylates, acrylate/maleate copolymers, styrene/acrylate copolymers, PEG/vinyl acrylate copolymers, silicone copolymers and numerous cationic polymers such as PVP, PVP/VI, starches, gums and many polyquaternium polymers well known in the art such as poly(dmdaac) are not useful as a substitute for the present phase-coupling purposes. Moreover, even certain structurally quite similar polymers to the presently selected polymers are not useful for phase coupling of the instant compositions.

Also surprisingly in view of the art, the present coupling polymers are different from the so-called "decoupling polymers" such as copolymers of sodium acrylate and lauryl methacrylate, which have previously been found useful to stabilize concentrated lamellar dispersions of surfactants. See for example Blonk et al, Colloids and Surfaces A, Physiochemical and Engineering Aspects, 144 (1998) 287-294 and Van de Pas et al, Colloids and Surfaces A, Physiochemical and Engineering Aspects, 85 (1994) 221-236. Indeed the present coupling polymers are specifically defined so as to exclude the known "deflocculating polymers" or "decoupling polymers" of the art.

Preferred coupling polymers herein present at a level of from 0.1% to 5% by weight of the laundry detergent composition, and a preferred coupling polymer is characterized by (i) an aliphatic backbone comprising at least two nitrogen atoms to which backbone are connected (ii) at least two side-chains comprising poly(alkoxylate) moieties. Very surprisingly, an improved result is obtained when said poly (alkoxylate) moieties consist essentially of poly(ethoxylate) moieties—in other words propoxylation, or partial propoxylation, is not preferred in the poly(ethoxylate) moieties.

Without intending to be limited by theory, it is believed that the present coupling polymers serve their useful purposes as a result of being amphiphilic with a correct combination of charge-based affinity for surfactant anions and having a correct proportion of charge screening so that the polymer associates with anionic surfactant so as to stabilize it against phase splits in and does so without forming solid-phase coacervate precipitates (when fabric care actives are present in the present compositions, it may nonetheless be possible to stabilize liquid phases of coacervates). Again without intending to be limited by theory, it is believed that the present coupling polymers stabilize small-sized colloidal dispersions of surfactant. On the other hand, the present invention does not rely on the coupling polymer alone, but at minimum, on a combination of the coupling polymer and an alkanolamine. This is believed to be due to the fact that in the concentration regimes of anionic surfactant with which the invention is concerned, there is a requirement for both components, the alkanolamine re-inforcing the effectiveness of the coupling polymer either by some kind of charge-modulating effect in its own right, or by Krafft boundary lowering of the anionic surfactant component (see the anionic surfactant disclosure hereinafter). Last, and for best overall effect, preferred compositional embodiments of the invention also require a crystalline structurant which surprisingly further stabilizes the compositions of the invention against phase splitting.

In terms of charge, the present coupling polymers can be zwitterionic (comprising anionic and cationic moieties with no net overall charge), fully quaternized (comprising cationic moieties) or can comprise a combination of fully quaternized nitrogen moieties and pH-dependent amino moieties which vary in charge as pH is changed.

In terms of overall geometry, the present coupling polymers include globular polymers and include polymers which can be termed "hyperbranched" or "dendritic".

In terms of molecular weight, the present coupling polymers can vary quite widely and may exhibit varying degrees of polydispersity, depending on the precise process used to manufacture them. Nonetheless, it is preferred to avoid overly monodisperse coupling polymer both on grounds of cost and of effectiveness; and it is preferred to avoid overly high molecular weights; for example number average molecular weights are below about 110,000 in preferred embodiments, more preferably below 50,000.

By way of selected coupling polymers useful herein are those disclosed in U.S. Pat. No. 4,551,506, e.g., TEPA which has been ethoxylated and quaternized; U.S. Pat. No. 4,622,378 e.g., TEPA or PEI which have been ethoxylated, quaternized and sulfated so as to provide a zwitterionic polymer; U.S. Pat. No. 4,659,802 e.g., Quat PEA189E24 or Quat HMDA E24; U.S. Pat. No. 4,661,288 e.g., Quat PEA189 E24 sulfate.

A highly preferred polymer for use as the coupling polymer has the following structure:

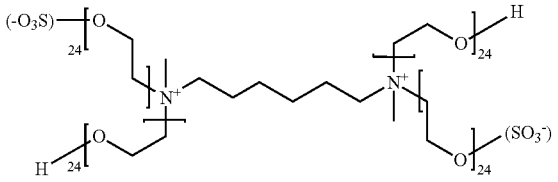

Another but surprisingly less preferred group of coupling polymers has the structure:

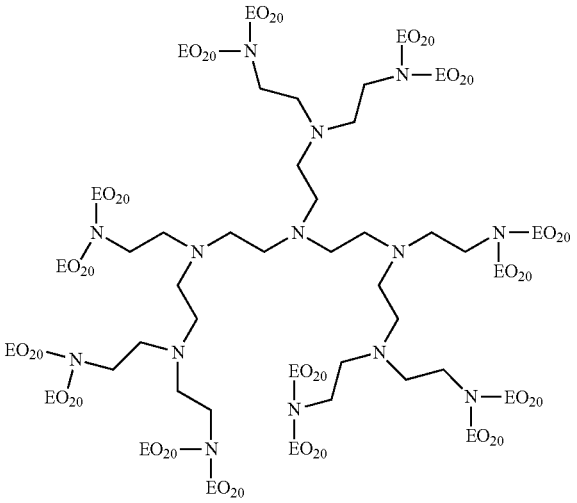

A preferred group of coupling polymers for use herein are described in WO 06113314A1. A preferred group of coupling polymers for use herein are also described in US 2007/0179270A1.

In these embodiments the present laundry detergent composition comprises from about 0.01 wt % to about 10 wt %, preferably from about 0.1 wt % to about 5 wt %, more preferably from about 0.3% to about 3% by weight of the composition of the coupling polymer.

A suitable coupling polymer of the present composition has a polyethyleneimine backbone having a molecular weight from about 300 to about 10000 weight average molecular weight, preferably from about 400 to about 7500 weight average molecular weight, preferably about 500 to about 1900 weight average molecular weight and preferably from about 3000 to 6000 weight average molecular weight.

The modification of the polyethyleneimine backbone includes: (1) one or two alkoxylation modifications per nitrogen atom, dependent on whether the modification occurs at a internal nitrogen atom or at an terminal nitrogen atom, in the polyethyleneimine backbone, the alkoxylation modification consisting of the replacement of a hydrogen atom on by a polyalkoxylene chain having an average of about 1 to about 40 alkoxy moieties per modification, wherein the terminal alkoxy moiety of the alkoxylation modification is capped with hydrogen, a $C_1$-$C_4$ alkyl or mixtures thereof; (2) a substitution of one $C_1$-$C_4$ alkyl moiety and one or two alkoxylation modifications per nitrogen atom, dependent on whether the substitution occurs at a internal nitrogen atom or at an terminal nitrogen atom, in the polyethyleneimine backbone, the alkoxylation modification consisting of the replacement of a hydrogen atom by a polyalkoxylene chain having an average of about 1 to about 40 alkoxy moieties per modification wherein the terminal alkoxy moiety is capped with hydrogen, a $C_1$-$C_4$ alkyl or mixtures thereof; or (3) a combination thereof.

For example, but not limited to, below is shown possible modifications to terminal nitrogen atoms in the polyethyleneimine backbone where R represents an ethylene spacer and E represents a $C_1$-$C_4$ alkyl moiety and $X^-$ represents a suitable water soluble counterion.

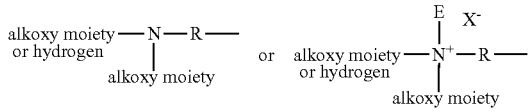

Also, for example, but not limited to, below is shown possible modifications to internal nitrogen atoms in the polyethyleneimine backbone where R represents an ethylene spacer and E represents a $C_1$-$C_4$ alkyl moiety and X− represents a suitable water soluble counterion.

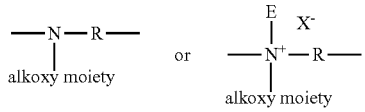

The alkoxylation modification of the polyethyleneimine backbone consists of the replacement of a hydrogen atom by a polyalkoxylene chain having an average of about 1 to about 40 alkoxy moieties, preferably from about 5 to about 20 alkoxy moieties. The alkoxy moieties are selected from ethoxy (EO), 1,2-propoxy (1,2-PO), 1,3-propoxy (1,3-PO), butoxy (BO), and combinations thereof. Preferably, the polyalkoxylene chain is selected from ethoxy moieties and ethoxy/propoxy block moieties with a limited upper amount of propoxy moieties. More preferably, the polyalkoxylene chain is ethoxy moieties in an average degree of from about 5 to about 25. When present, ethoxy/propoxy block moieties having an average degree of ethoxylation from about 5 to about 15 and an average degree of propoxylation up to no more than from about 5 and wherein the propoxy moiety block is the terminal alkoxy moiety block. More preferably, only ethoxy moieties are present.

The modification may result in permanent quaternization of the polyethyleneimine backbone nitrogen atoms. The degree of permanent quaternization may be from 0% to about 30% of the polyethyleneimine backbone nitrogen atoms. It is preferred to have less than 30% of the polyethyleneimine backbone nitrogen atoms permanently quaternized.

A preferred modified polyethyleneimine has the general structure of formula (I):

formula (I)

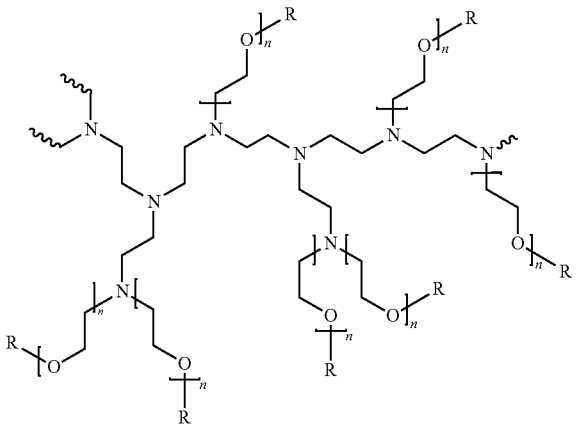

wherein the polyethyleneimine backbone has a weight average molecular weight of 5000, n of formula (I) has an average of 7 and R of formula (I) is selected from hydrogen, a $C_1$-$C_4$ alkyl and mixtures thereof.

Another preferred polyethyleneimine has the general structure of formula (II):

formula (II)

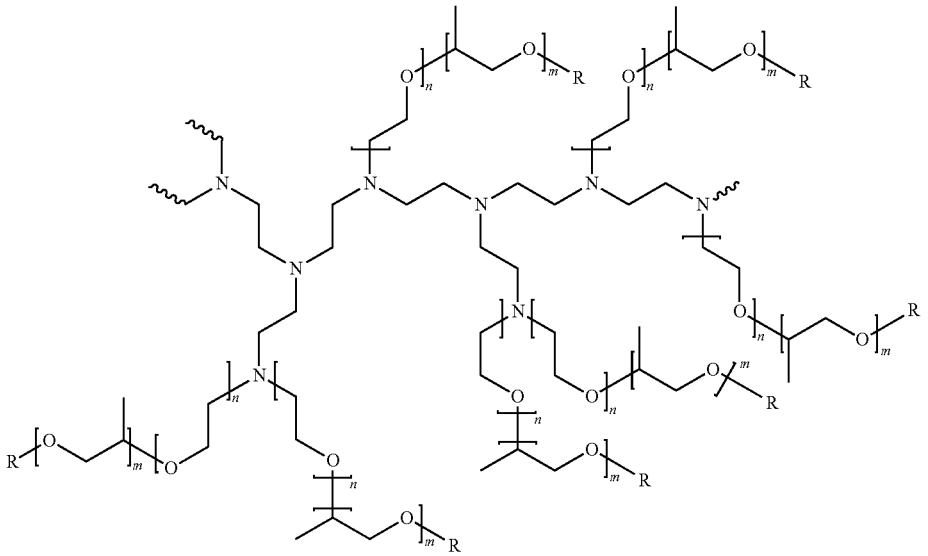

wherein the polyethyleneimine backbone has a weight average molecular weight of 5000, n of formula (II) has an average of 10, m of formula (II) has an average of 7 and R of formula (II) is selected from hydrogen, a $C_1$-$C_4$ alkyl and mixtures thereof. The degree of permanent quaternization of formula (II) may be from 0% to about 22% of the polyethyleneimine backbone nitrogen atoms.

Yet another preferred polyethyleneimine has the same general structure of formula (II) where the polyethyleneimine backbone has a weight average molecular weight of 600, n of formula (II) has an average of 10, m of formula (II) has an average of 7 and R of formula (II) is selected from hydrogen, a $C_1$-$C_4$ alkyl and mixtures thereof. The degree of permanent quaternization of formula (II) may be from 0% to about 22% of the polyethyleneimine backbone nitrogen atoms.

These polyethyleneimines can be prepared, for example, by polymerizing ethyleneimine in the presence of a catalyst such as carbon dioxide, sodium bisulfite, sulfuric acid, hydrogen peroxide, hydrochloric acid, acetic acid, and the like. Specific methods for preparing these polyamine backbones are disclosed in U.S. Pat. No. 2,182,306, Ulrich et al., issued Dec. 5, 1939; U.S. Pat. No. 3,033,746, Mayle et al., issued May 8, 1962; U.S. Pat. No. 2,208,095, Esselmann et al., issued Jul. 16, 1940; U.S. Pat. No. 2,806,839, Crowther, issued Sep. 17, 1957; and U.S. Pat. No. 2,553,696, Wilson, issued May 21, 1951.

Alkanolamine

Alkanolamine is an essential component of the present invention. Without wishing to be bound by theory, it is believed that alkanolamine is multifunctional. Most importantly for the present purposes, certain alkanolamines e.g., monoethanolamine, diethanolamine, triethanolamine and triisopropanolamine are effective at low levels to act on suppression of lamellar phases, or as coupling agents. Alkanolamines are also known in the art to act as buffers and as aminofunctional solvents, when sufficient amounts are present, but this is not the primary intent of providing alkanolamines in the present processes and compositions. Alkanolamines can of course react with the acid form anionic surfactant species to form an alkanolamine neutralized anionic surfactant. As such, alkanolamine can be introduced into a premix either by combining alkanolamine and acid-form anionic surfactant, e.g., HLAS in-situ in the premix, or by any other suitable means such as by separately neutralizing HLAS with alkanolamine and adding the neutral alkanolamine-LAS to the premix. However, in some embodiments it may be desirable that alkanolamine be preformulated into a crystalline structurant premix in stoichiometric excess over the amount required to neutralize the acid form of the anionic surfactants present in the premix. In such embodiments, the alkanolamine may serve the dual purpose of acting as part of the emulsifying surfactant for the crystalline structurant, and as a buffer. In some embodiments, the alkanolamine may be present at a level of from about 2% to about 10%, from about 3% to about 8%, or from about 3% to about 6% by weight of the structuring system. In some embodiments, the alkanoamine may be present at about 5% by weight of the structuring system.

In general, any suitable alkanolamine or mixture of alkanolamines may be of use in the present invention. Suitable alkanolamines may be selected from the lower alkanol mono-, di-, and trialkanolamines, such as monoethanolamine; diethanolamine, triethanolamine, triisopropylamine or mixtures thereof. Higher alkanolamines have higher molecular weight and may be less mass efficient for the present purposes. Mono- and di-alkanolamines are preferred for mass efficiency reasons. Monoethanolamine is particularly preferred, however an additional alkanolamine, such as triethanolamine, can be useful in certain embodiments as a buffer. Moreover it is envisioned that in some embodiments of the invention, alkanolamine salts of anionic surfactants other than the aliquots used in preparing crystalline structurant premixes can be added separately to the final detergent formulation, for example for known purposes such as solvency, buffering, the management of chlorine in wash liquors, and/or for enzyme stabilization in laundry detergent products.

Crystalline Structurant

The present compositions comprise from about 0.01% to about 5%, preferably from about 0.05% to about 1.5% of any suitable crystalline structurant. A non-limiting example of a suitable crystalline structurant is a crystallizable glyceride or mixture of crystallizable glycerides having a melting point of from about 40° C. to about 100° C.

Crystallizable glyceride(s) of use herein include "Hydrogenated castor oil" or "HCO". HCO as used herein most generally can be any hydrogenated castor oil, provided that it is capable of crystallizing in a premix serving to deliver the crystalline structurant into the final detergent composition. Castor oils may include glycerides, especially triglycerides, comprising $C_{10}$ to $C_{22}$ alkyl or alkenyl moieties which incorporate a hydroxyl group. Hydrogenation of castor oil to make HCO converts double bonds, which may be present in the starting oil as ricinoleyl moieties, to convert ricinoleyl moieties to saturated hydroxyalkyl moieties, e.g., hydroxystearyl. The HCO herein may, in some embodiments, be selected from: trihydroxystearin; dihydroxystearin; and mixtures thereof. The HCO may be processed in any suitable starting form, including, but not limited those selected from solid, molten and mixtures thereof. HCO is typically present in structurant premixes of the present invention at a level of from about 2% to about 10%, from about 3% to about 8%, or from about 4% to about 6% by weight of the structuring system. In some embodiments, the corresponding percentage of hydrogenated castor oil delivered into a finished laundry detergent product is below about 1.0%, typically from 0.1% to 0.8%.

Useful HCO may have the following characteristics: a melting point of from about 40° C. to about 100° C., or from about 65° C. to about 95° C.; and/or Iodine value ranges of from 0 to about 5, from 0 to about 4, or from 0 to about 2.6. The melting point of HCO can measured using either ASTM D3418 or ISO 11357; both tests utilize DSC: Differential Scanning Calorimetry.

HCO of use in the present invention includes those that are commercially available. Non-limiting examples of commercially available HCO of use in the present invention include: THIXCIN® from Rheox, Inc. Further examples of useful HCO may be found in U.S. Pat. No. 5,340,390. The source of the castor oil for hydrogenation to form HCO can be of any suitable origin, such as from Brazil or India. In one suitable embodiment, castor oil is hydrogenated using a precious metal, e.g., palladium catalyst, and the hydrogenation temperature and pressure are controlled to optimize hydrogenation of the double bonds of the native castor oil while avoiding unacceptable levels of dehydroxylation.

The invention is not intended to be directed only to the use of hydrogenated castor oil. Any other suitable crystallizable glyceride(s) may be used. In one example, the structurant is substantially pure triglyceride of 12-hydroxystearic acid. This molecule represents the pure form of a fully hydrogenated triglyceride of 12-hydrox-9-cis-octadecenoic acid. In nature, the composition of castor oil is rather constant, but may vary somewhat. Likewise hydrogenation procedures may vary. Any other suitable equivalent materials, such as mixtures of triglycerides wherein at least 80% wt. is from castor oil, may be used. Exemplary equivalent materials comprise primarily, or consist essentially of, triglycerides; or comprise primarily, or consist essentially of, mixtures of diglycerides and triglycerides; or comprise primarily, or consist essentially of, mixtures of triglyerides with diglycerides and limited amounts, e.g., less than about 20% wt. of the glyceride mixtures, of monoglyerides; or comprise primarily, or consist essentially of, any of the foregoing glycerides with limited amounts, e.g., less than about 20% wt., of the corresponding acid hydrolysis product of any of said glycerides. A proviso in the above is that the major proportion, typically at least 80% wt, of any of said glycerides is chemically identical to glyceride of fully hydrogenated ricinoleic acid, i.e., glyceride of 12-hydroxystearic acid. It is for example well known in the art to modify hydrogenated castor oil such that in a given triglyceride, there will be two 12-hydroxystearic-moieties and one stearic moiety. Likewise it is envisioned that the hydrogenated castor oil may not be fully hydrogenated. In contrast, the invention excludes poly(oxyalkylated) castor oils when these fail the melting criteria.

Other suitable crystalline structurants herein can be of any known type. For example, microfibrillated cellulose is another useful crystalline structurant for use herein.

Anionic Nonsoap Surfactant

The present compositions comprise at least 10%, preferably more such as from about 15% to about 30% of any suitable anionic nonsoap surfactant provided that at the total surfactant level in the detergent composition is at least 20% by weight including other surfactants mentioned hereinafter. Preferably, at least 1% of the anionic nonsoap surfactant is an alkyl(polyalkoxy)sulfate. For overall formula accounting purposes, "soaps" and "fatty acids" are accounted as builders. Otherwise, any suitable anionic nonsoap surfactant is of use in the present invention.

Preferred anionic surfactants herein possess what is termed "low Krafft temperatures". The term "Krafft temperature" as used herein is a term of art which is well-known to workers in the field of surfactant sciences. Krafft temperature is described by K. Shinoda in the text "Principles of Solution and Solubility", translation in collaboration with Paul Becher, published by Marcel Dekker, Inc. 1978 at pages 160-161. "Krafft temperature" for the present purposes is measured by taking the sodium salt of an anionic surfactant having a single chainlength; and measuring the clearing temperature of a 1 wt % solution of that surfactant. Alternative well-known art techniques include Differential Scanning Calorimetry (DSC). See W. Kunz et al., Green Chem., 2008, Vol 10, pages 433-435. Preferred embodiments of the present invention employ anionic surfactants for which the corresponding sodium salt has a Krafft temperature below about 50° C., more preferably, below about 40° C., more preferably still, below about 30°, more preferably still below about 10° C. or below about 20° C., or below 0° C.

Stated succinctly, the solubility of an anionic surfactant in water increases rather slowly with temperature up to that point, i.e., the Krafft temperature, at which the solubility evidences an extremely rapid rise. At a temperature of approximately 4° C. above the Krafft temperature, a surfactant solution of almost any soluble anionic surfactant becomes a single, homogeneous phase. In general, the Krafft temperature of any given type of anionic surfactant will vary with the chain length of the hydrocarbyl group; this is due to the change in water solubility with the variation in the hydrophobic portion of the surfactant molecule.

Under circumstances where the anionic surfactant herein comprises a mixture of alkyl chain lengths, the Krafft temperature will not be a single point but, rather, will be denoted as a "Krafft boundary". Such matters are well-known to those skilled in the science of surfactant/solution measurements. In any event, for such mixtures of anionic surfactants, what will be measured is the Krafft temperature of at least the longest chain-length surfactant present at a level of at least 10% by weight in such mixtures.

Krafft temperatures of single surfactant species are related to melting temperatures. The general intent herein, when using mixtures of anionic surfactants to emulsify hydrogenated castor oil or similarly crystallizable glycerides, is to obtain low melt temperatures of the collectivity of anionic surfactant molecules in the anionic surfactant mix.

A preferred group of anionic surfactants for inclusion herein are synthetic anionic surfactants having a specified HI index. The "Hydrophilic Index", ("HI") of an anionic surfactant herein is as defined in WO 00/27958A1 (Reddy et al.). Low HI synthetic anionic surfactants, e.g., HI<8 are preferred herein.

More particularly it is preferred to use alkanolamine neutralized forms of a synthetic anionic nonsoap surfactant for which the corresponding Na-salt of the anionic surfactant has HI below 8, preferably below 6, more preferably, below 5.

Without intending to be limited by theory, melting of anionic surfactant is majorly influenced by its hydrophobic group, while HI depends on a balanced ratio of hydrophilic and hydrophobic groups.

For example AE3S is undesirably hydrophilic for use in crystalline structurant premixes according to HI and has low Kraft point or melting temperature, which is desirable for use in the crystalline structurant premixes; while LAS, especially LAS not having more than a limited amount of 2-phenyl isomers, is both desirably hydrophobic according to HI value for use in the crystalline structurant premixes, and can be selected to have low melting temperatures (including molecules having low Krafft point), rendering its use preferred in the crystalline structurant premixes. Note however, that when formulating the balance of the laundry detergent composition, it may be desirable in some embodiments to introduce, separately from the crystalline structurant premixes, an appreciable amount of AES-type surfactants for their known resistance to water hardness and good whiteness benefits.

In one embodiment the anionic surfactants used in the crystalline structurant premixes can have pKa values of less than 7, although anionic surfactants having other pKa values may also be usable.

Non-limiting examples of suitable anionic surfactants of use herein include: Linear Alkyl Benzene Sulphonate (LAS), Alkyl Sulphates (AS), Alkyl Ethoxylated Sulphonates (AES), Laureth Sulfates and mixtures thereof. In some embodiments, the anionic surfactant may be present in the external structuring system at a level of from about 5% to about 50%. Note however, that when using more than about 25% by weight of the crystalline structurant premixes of an anionic surfactant, it is typically required to thin the surfactant using an organic solvent in addition to water. Suitable solvents are listed hereinafter.

Further, when selecting the anionic surfactant for the crystalline structurant premix, and an alkylbenzene sulfonate surfactant is chosen for this purpose, it is preferred to use any of (1) alkylbenzene sulfonates selected from HF-process derived linear alkylbenzenes and/or (2) mid-branched LAS (having varying amounts of methyl side-chains—see for example U.S. Pat. No. 6,306,817, U.S. Pat. No. 6,589,927, U.S. Pat. No. 6,583,096, U.S. Pat. No. 6,602,840, U.S. Pat. No. 6,514,926, U.S. Pat. No. 6,593,285. Other preferred LAS sources include (3) those available from Cepsa LAB, see WO 09/071709A1; and (4) those available from UOP LAB, see WO 08/055121A2. In contrast, LAS derived from DETAL™ process (UOP, LLC, Des Plaines, Ill.) process and/or LAS having high 2-phenyl content as taught by Huntsman (see for example U.S. Pat. No. 6,849,588 or US 2003/0096726A1 and having, for example, more than 70% or 80% 2-phenyl isomer content) are preferably avoided for use in the crystalline structurant premix, although they may be incorporated into the final laundry detergent compositions. Without intending to be limited by theory, excessive 2-phenyl isomer content leads to undesirably high melting temperatures of the LAS.

As noted previously, the anionic surfactant can be introduced into the crystalline structurant premixes either as the acid form of the surfactant, and/or pre-neutralized with the alkanolamine. In no case is the anionic surfactant used as a sodium-neutralized form; more generally, the anionic surfactant is not used in the form of any monovalent or divalent inorganic cationic salt such as the sodium, potassium, lithium, magnesium, or calcium salts. Preferably, the crystalline structurant premixes and the laundry detergents herein comprise less than about 5%, 2% or 1% of monovalent inorganic cations such as sodium or potassium. In a preferred embodiment, no (i.e., 0%) in total of monovalent and/or divalent inorganic metal ions whatsoever are added to the crystalline structurant premixes, and no soap is deliberately added in making the crystalline structurant premixes. In other words, the crystalline structurant premixes are substantially free from monovalent and/or divalent inorganic metal ions.

Other Surfactant, e.g. Nonionic Surfactant

The present compositions comprise in preferred embodiments at least 1%, preferably from about 5% to about 15% of any suitable nonionic surfactant. Suitable nonionic surfactants useful herein can comprise any of the conventional nonionic surfactant types typically used in liquid detergent products. These include alkoxylated fatty alcohols. Preferred for use in the liquid detergent products herein are those nonionic surfactants which are normally liquid. Preferred nonionic surfactants for use herein include the alcohol alkoxylate nonionic surfactants. Alcohol alkoxylates are materials which correspond to the general formula:

$$R^1(C_mH_{2m}O)_nOH$$

wherein R1 is a C8-C16 alkyl group, m is from 2 to 4, and n ranges from about 2 to 12. Preferably R1 is an alkyl group, which may be primary or secondary, which contains from about 9 to 15 carbon atoms, more preferably from about 10 to 14 carbon atoms. Preferably also the alkoxylated fatty alcohols will be ethoxylated materials that contain from about 2 to 12 ethylene oxide moieties per molecule, more preferably from about 3 to 10 ethylene oxide moieties per molecule.

The alkoxylated fatty alcohol materials useful in the liquid detergent compositions herein will frequently have a hydrophilic-lipophilic balance (HLB) which ranges from about 3 to 17. More preferably, the HLB of this material will range from about 6 to 15, most preferably from about 8 to 15. Alkoxylated fatty alcohol nonionic surfactants have been marketed under the tradenames Neodol™ and Dobanol™ by the Shell Chemical Company (Houston, Tex.).

Another suitable type of nonionic surfactant useful herein comprises the amine oxide surfactants. Amine oxides are materials which are often referred to in the art as "semi-polar" nonionics. Amine oxides have the formula: R(EO)x(PO)y(BO)zN(O)(CH2R')2.qH2O. In this formula, R is a relatively long-chain hydrocarbyl moiety which can be saturated or unsaturated, linear or branched, and can contain from 8 to 20, preferably from 10 to 16 carbon atoms, and is more preferably C12-C16 primary alkyl. R' is a short-chain moiety preferably selected from hydrogen, methyl and —CH2OH. When x+y+z is different from 0, EO is ethyleneoxy, PO is propyleneneoxy and BO is butyleneoxy. Amine oxide surfactants are illustrated by C12-14 alkyldimethyl amine oxide; suitable levels, when present, are from about 0.1% to about 5% of the detergent compositions.

Organic, Non-Aminofunctional Solvent

The present compositions in preferred embodiment comprise at least about 1%, preferably from about 2% to about 15% of an organic, non-aminofunctional solvent. As used herein, "non-aminofunctional solvent" refers to any solvent which contains no amino functional groups, indeed contains no nitrogen. Non-aminofunctional solvent include, for example: $C_1$-$C_5$ alkanols such as methanol, ethanol and/or propanol and/or 1-ethoxypentanol; $C_2$-$C_6$ diols; $C_3$-$C_8$ alkylene glycols; $C_3$-$C_8$ alkylene glycol mono lower alkyl ethers; glycol dialkyl ether; lower molecular weight polyethylene glycols; $C_3$-$C_9$ triols such as glycerol; and mixtures thereof. More specifically non-aminofunctional solvent are liquids at ambient temperature and pressure (i.e. 21° C. and 1 atmosphere), and comprise carbon, hydrogen and oxygen.

Thus organic non-aminofunctional organic solvents may be present when preparing the crystalline structurant premixes, or in the final detergent composition. Preferred organic non-aminofunctional solvents include monohydric alcohols, dihydric alcohols, polyhydric alcohols, glycerol, glycols, polyalkylene glycols such as polyethylene glycol, and mixtures thereof. Highly preferred are mixtures of solvents, especially mixtures of lower aliphatic alcohols such as ethanol, propanol, butanol, isopropanol, and/or diols such as 1,2-propanediol or 1,3-propanediol; or mixtures thereof with glycerol. Suitable alcohols especially include a C1-C4 alcohol. Preferred is 1,2-propanediol or ethanol and mixtures thereof, or propanediol and mixtures thereof with diethylene glycol where the mixture contains no methanol or ethanol. Thus the invention includes embodiments in which propanediols are used but methanol and ethanol are not used. In the crystalline structurant premixes, organic non-aminofunctional solvents may be present at levels of from 0 to about 30 weight %, more typically from 0 about 20 weight %, and in some embodiments from about 1 to about 5 weight %, of the crystalline structurant premix.

Laundering adjuncts, especially selected from detergent active enzymes, textile optical brighteners and fabric hueing dyes:

Enzymes: The fluid detergent compositions of the present invention may comprise from about 0.0001% to about 5% by weight or more (depending on activity of commercial enzyme preparations) of a detersive enzyme, alternatively from about 0.001 to about 2%, alternatively from about 0.01 to about 1%.

In one preferred embodiment, the detersive enzyme comprises a protease in combination with amylase and a cellulase or xyloglucanase and the crystalline structurant is hydrogenated castor oil. In yet another preferred embodiment, the detersive enzyme comprises lipase in combination with protease, amylase and pectate lyase and the crystalline structurant is microfibrillar cellulose. Exemplary lipases are available from Novozymes as Lipolase®, Lipolase Ultra®, Lipolex®, Lipoprime® and Lipex®

For purposes of the present invention, the degree of identity between two amino acid sequences is determined using the Needleman-Wunsch algorithm (Needleman and Wunsch, 1970, J. Mol. Biol. 48: 443-453) as implemented in the Needle program of the EMBOSS package (EMBOSS: The European Molecular Biology Open Software Suite, Rice et al., 2000, Trends in Genetics 16: 276-277; http://emboss.org), preferably version 3.0.0 or later. The optional parameters used are gap open penalty of 10, gap extension penalty of 0.5, and the EBLOSUM62 (EMBOSS version of BLOSUM62) substitution matrix. The output of Needle labeled "longest identity" (obtained using the—nobrief option) is used as the percent identity and is calculated as follows:

(Identical Residues×100)/(Length of Alignment−Total Number of Gaps in Alignment)

For purposes of the present invention, the degree of identity between two deoxyribonucleotide sequences is determined using the Needleman-Wunsch algorithm (Needleman and Wunsch, 1970, supra) as implemented in the Needle program of the EMBOSS package (EMBOSS: The European Molecular Biology Open Software Suite, Rice et al., 2000, supra; http://emboss.org), preferably version 3.0.0 or later. The optional parameters used are gap open penalty of 10, gap extension penalty of 0.5, and the EDNAFULL (EMBOSS version of NCBI NUC4.4) substitution matrix. The output of Needle labeled "longest identity" (obtained using the—nobrief option) is used as the percent identity and is calculated as follows:

(Identical Deoxyribonucleotides×100)/(Length of Alignment−Total Number of Gaps in Alignment)

The detersive enzyme of the present invention can be present in the fluid detergent and/or can be encapsulated. Where the detergent enzyme is encapsulated, there is still a likelihood that the detersive enzyme can leach or otherwise escape the encapsulating material and therefore affect any enzyme sensitive ingredients present in the fluid detergent, such as the structurants in the composition.

In a one aspect, the composition may comprise one or more additional detersive enzymes which provide cleaning performance benefits. Said additional detersive enzymes include enzymes selected from cellulases, endoglucanases, hemicellulases, peroxidases, proteases, gluco-amylases, amylases, cutinases, pectinases, xylanases, reductases, oxidases, phenoloxidases, lipoxygenases, ligninases, pullulanases, tannases, pentosanases, malanases, β-glucanases, arabinosidases, mannanases, xyloglucanases or mixtures thereof. A preferred combination is a fluid detergent composition having a cocktail of conventional applicable enzymes like protease, amylase, cutinase, mannanases, xyloglucanases and/or cellulase and the crystalline structurant is hydrogenated castor oil. Enzymes when present in the compositions, at from about 0.0001% to about 5% of active enzyme by weight.

Known cellulases include endoglucanase (E.C.3.2.1.4) enzyme produced by *Bacillus* sp. AA349 such as CELLUCLEAN® as well as CELLUZYME from Novozymes. Additional cellulase enzymes suitable for use in the present invention include those disclosed in WO Publ. 2004/053039A2, WO Publ. 2002/099091A2, U.S. 2004/0002431A1, U.S. Pat. No. 4,945,053, and U.S. Pat. No. 4,978,470. Additional endoglucanase enzymes which can be used in accordance with the present invention include xyloglucanases such as disclosed in WO0162903A1 to Novozymes.

In one aspect, the compositions and methods of the present invention may include a protease enzyme from about 0.0001% to about 5%, specifically from about 0.001% to about 2%, more specifically from about 0.001% to about 1%, even more specifically from about 0.001% to about 0.2%, even more specifically still from about 0.005% to about 0.1%, by weight of a protease enzyme. Any protease suitable for use in detergents can be used. Such proteases can be of animal, vegetable or microbial origin, with both modified (chemical or genetically variants) and unmodified proteases included.

One class of suitable proteases include the so-called serine endopeptidases [E.C. 3.4.21] and an example of which are the serine protease [E.C. 3.4.21.62]. Illustrative non-limiting examples of serine proteases includes subtilisins, e.g. subtilisins derived from *Bacillus* (e.g. *B. subtilis, B. lentus, B. licheniformis, B. amyloliquefaciens, B. alcalophilus*), for example, subtilisins BPN and BPN', subtilisin Carlsberg, subtilisin 309, subtilisin 147, subtilisin 168, subtilisin PB92, their mutants and mixtures thereof.

Illustrative non-limiting examples of commercially available serine proteases, include, Alcalase®, Savinase®, Kannase®, Everlase® available from Novozymes; Purafect®, Purastar OxAm®, Properase® available from Genencor; BLAP and BLAP variants available from Henkel; and K-16-like proteases available from KAO. Additional illustrative proteases are described in e.g. EP130756, WO91/06637, WO95/10591, WO99/20726, U.S. Pat. No. 5,030,378 (Protease "A") and EP251446 (Protease "B").

Examples of commercial α-amylases products are Purafect Ox Am® from Genencor and Termamyl®, Termamyl Ultra® Ban®, Fungamyl® and Duramyl®, all available from Novo Nordisk A/S Denmark. WO95/26397 describes other suitable amylases: α-amylases characterised by having a specific activity at least 25% higher than the specific activity of Termamyl® at a temperature range of 25° C. to 55° C. and at a pH value in the range of 8 to 10, measured by the Phadebas® α-amylase activity assay. Suitable are variants of the above enzymes, described in WO96/23873 (Novo Nordisk). Other amylolytic enzymes with improved properties with respect to the activity level and the combination of thermostability and a higher activity level are described in WO95/35382.

The compositions of the present invention may also comprise a mannanase enzyme. The mannanase can be selected from the group consisting of: three mannans-degrading enzymes: EC 3.2.1.25: β-mannosidase, EC 3.2.1.78: Endo-1,4-β-mannosidase, referred therein after as "mannanase" and EC 3.2.1.100: 1,4-β-mannobiosidase and mixtures thereof. (IUPAC Classification—Enzyme nomenclature, 1992 ISBN 0-12-227165-3 Academic Press).

Alternatively, the compositions of the present invention, when a mannanase is present, comprise a β-1,4-Mannosidase (E.C. 3.2.1.78) referred to as Mannanase. The term "mannanase" or "galactomannanase" denotes a mannanase enzyme defined according to the art as officially being named mannan endo-1,4-beta-mannosidase and having the alternative names beta-mannanase and endo-1,4-mannanase and catalysing the reaction: random hydrolysis of 1,4-beta-D-mannosidic linkages in mannans, galactomannans, glucomannans, and galactoglucomannans.

Mannanases (EC 3.2.1.78) constitute a group of polysaccharases which degrade mannans and denote enzymes which are capable of cleaving polyose chains containing mannose units, i.e. are capable of cleaving glycosidic bonds in mannans, glucomannans, galactomannans and galactoglucomannans. Mannans are polysaccharides having a backbone composed of β-1,4-linked mannose; glucomannans are polysaccharides having a backbone or more or less regularly alternating β-1,4 linked mannose and glucose; galactomannans and galactoglucomannans are mannans and glucomannans with α-1,6 linked galactose sidebranches. These compounds may be acetylated.

Detersive enzymes for use herein can be formulated using known techniques to stabilize the enzyme. Such techniques include the use of low levels, e.g., from 0.01% to 0.2% of the detergent composition, of a soluble calcium and/or magnesium salt, such as calcium chloride. Other known enzyme stabilizers include borax, borax-polyol complexes e.g., with sorbitol, protease inhibitors such as 4-FPBA and the like.

Optical brighteners otherwise known as fluorescent whitening agents for textiles are useful laundering adjuncts in the present laundry detergent compositions. Suitable use levels are from about 0.001% to about 1% by weight of the laundry detergent composition. Brighteners are for example disclosed in EP 686691B and include hydrophobic as well as hydrophilic types. Brightener 49 is preferred for use herein.

Hueing or Shading Dyes

Hueing dyes, shading dyes or fabric shading or hueing agents are useful laundering adjuncts in the present laundry detergent compositions. The history of these materials in laundering is a long one, originating with the use of "laundry blueing agents" many years ago. More recent developments include the use of sulfonated phthalocyanine dyes having a Zinc or aluminum central atom; and still more recently a great variety of other blue and/or violet dyes have been used for their hueing or shading effects. See for example WO 2009/087524 A1, WO2009/087034A1 and references therein. The laundry detergent compositions herein typically comprise from about 0.00003 wt % to about 0.1 wt %, from about 0.00008 wt % to about 0.05 wt %, or even from about 0.0001 wt % to about 0.04 wt %, fabric hueing agent.

Multivalent Water-Soluble Organic Builder and/or Chelant

The present compositions generally comprise at least about 0.1% by weight, preferably more e.g., up to about 10% by weight of one or more multivalent water-soluble organic builders and/or chelants. Citrate e.g., as MEA citrate or citric acid or other low molecular weight multivalent carboxylates such as NTA or EDTA are also useful in this role.

Other examples of multivalent water-soluble organic builder and/or chelants include organic phosphonates such as the aminoalkylenepoly(alkylene phosphonates), alkali metal ethane 1-hydroxy disphosphonates, and nitrilotrimethylene phosphonates. Depending on geography, phosphonates may not be used for regulatory reasons. In one embodiment, the chelant is diethylene triamine penta(methylene phosphonic acid) (DTPMP), ethylene diamine tetra(methylene phosphonic acid) (DDTMP), hexamethylene diamine tetra(methylene phosphonic acid), hydroxy-ethylene 1,1 diphosphonic acid (HEDP), or hydroxyethane dimethylene phosphonic acid.

Other useful chelants and/or sequestrants herein include ethylene di-amine di-succinic acid (EDDS), ethylene diamine tetraacetic acid (EDTA), hydroxyethylethylenediamine triacetate (HEDTA; VERSENOL 120), nitrilotriacetate (NTA), methylglycinediacetate (MGDA), iminodisuccinate (IDS), hydroxyethyliminodisuccinate (HIDS), hydroxyethyliminodiacetate (HEIDA), glycine diacetate (GLDA), diethylene triamine pentaacetic acid (DTPA), or mixtures thereof. Further, chelants or sequestrants can include catechol sulfonate related preparations such as Tiron™, or combinations thereof with other chelants or sequestrants.

Water

In one embodiment, the water content of the present compositions is from about 5% to about 45%. More preferably the water content is from about 5% to about 35%. In certain preferred embodiments, the sum of water and non-aminofunctional solvent, by weight of the composition, is from 5% to 45%, specifically 10% to 30% by weight of the composition specifically no more than about 40%, more specifically no more than 35%, more specifically still no more than 30%, even more specifically still no more than 25%, by weight of the composition, and specifically having from about 0% to about 25%, more specifically from about 1% to about 20%, more specifically still from about 5% to about 15%, by weight of the composition, of the non-aminofunctional solvent.

In general the crystalline structurants herein can be prepared as premixes comprising water, typically at levels of from 5% to 90%, preferably from 10% to 80%, more preferably from 30% to 70%. However organic non-aminofunctional organic solvents, typically consisting essentially of C, H and O (i.e., non-silicones and heteroatom-free) may also be present in the crystalline structurant premixes as solvents to help control or reduce viscosity, especially during processing. The combination of water and non-aminofunctional organic solvent is sometimes referred to as a "liquid carrier".

Optional Ingredients

Fatty acid and/or soluble salts thereof may be included in some embodiments of the present composition. Fatty acids and/or soluble salts thereof are known to possess multiple functionalities in detergents, acting as surfactants, builders, thickeners, foam suppressors etc. Therefore, for avoidance of doubt, for formula accounting purposes and in preferred embodiments herein, soaps and fatty acids are listed separately. Moreover, soaps are commonly neutralized or partially neutralized in-situ in the formulation using neutralizers such as sodium hydroxide, potassium hydroxide and/or alkanolamines such as MEA.

Any soluble soap or fatty acid is suitable for use herein, including, lauric, myristic, palmitic stearic, oleic, linoleic, linolenic acid, and mixtures thereof. Naturally obtainable fatty acids, which are usually complex mixtures, are also suitable (such as tallow, coconut, and palm kernel fatty acids). In one embodiment, from about 0% to about 15%, by weight of the composition, of fatty acid may be present in the composition.

Preservative

Preservatives such as soluble preservatives may be added to the crystalline structurant premixes or to the final detergent product so as to limit contamination by microorganisms. Such contamination can lead to colonies of bacteria and fungi capable of resulting in phase separation, unpleasant, e.g., rancid odors and the like. The use of a broad-spectrum preservative, which controls the growth of bacteria and fungi is preferred. Limited-spectrum preservatives, which are only effective on a single group of microorganisms may also be used, either in combination with a broad-spectrum material or in a "package" of limited-spectrum preservatives with additive activities. Depending on the circumstances of manufacturing and consumer use, it may also be desirable to use more than one broad-spectrum preservative to minimize the effects of any potential contamination.

The use of both biocidal materials, i.e. substances that kill or destroy bacteria and fungi, and biostatic preservatives, i.e. substances that regulate or retard the growth of microorganisms, may be indicated for this invention.

In order to minimize environmental waste and allow for the maximum window of formulation stability, it is preferred that preservatives that are effective at low levels be used. Typically, they will be used only at an effective amount. For the purposes of this disclosure, the term "effective amount" means a level sufficient to control microbial growth in the product for a specified period of time, i.e., two weeks, such that the stability and physical properties of it are not negatively affected. For most preservatives, an effective amount will be between about 0.00001% and about 0.5% of the total formula, based on weight. Obviously, however, the effective level will vary based on the material used, and one skilled in the art should be able to select an appropriate preservative and use level.

Preferred preservatives for the compositions of this invention include organic sulphur compounds, halogenated materials, cyclic organic nitrogen compounds, low molecular weight aldehydes, quaternary ammonium materials, dehydroacetic acid, phenyl and phenoxy compounds and mixtures thereof.

Examples of preferred preservatives for use in the compositions of the present invention include: a mixture of about 77% 5-chloro-2-methyl-4-isothiazolin-3-one and about 23% 2-methyl-4-isothiazolin-3-one, which is sold commercially as a 1.5% aqueous solution by Rohm & Haas (Philadelphia, Pa.) under the trade name Kathon; 1,2-benzisothiazolin-3-one, which is sold commercially by Avecia (Wilmington, Del.) as, for example, a 20% solution in dipropylene glycol sold under the trade name Proxel™ GXL sold by Arch Chemicals (Atlanta, Ga.); and a 95:5 mixture of 1,3 bis(hydroxymethyl)-5,5-dimethyl-2,4 imidazolidinedione and 3-butyl-2-iodopropynyl carbamate, which can be obtained, for example, as Glydant Plus from Lonza (Fair Lawn, N.J.). The preservatives described above are generally only used at an effective amount to give product stability. It is conceivable, however, that they could also be used at higher levels in the compositions on this invention to provide a biostatic or antibacterial effect on the treated articles. A highly preferred preservative system is sold commercially as Acticide™ MBS and comprises the actives methyl-4-isothiazoline (MIT) and 1,2-benzisothizolin-3-one (BIT) in approximately equal proportions by weight and at a total concentration in the Acticide™ MBS of about 5%. The Acticide is formulated at levels of about 0.001 to 0.1%, more typically 0.01 to 0.1% by weight on a 100% active basis in the crystalline structurant premix.

Thickeners Other than Crystalline Structurants

Polymeric thickeners known in the art, e.g., Carbopol™ from Lubrizol (Wickliffe, Ohio), acrylate copolymers such as those known as associative thickeners and the like may be used to supplement the crystalline structurant premixes. These materials may be added either in the crystalline structurant premix, or separately into the final detergent composition. Additionally or alternatively known LMOG (low molecular weight organogellants) such as dibenzylidene sorbitol may be added to the compositions either in the crystalline structurant premix, or in the final detergent compositions. Suitable use levels are from about 0.01% to about 5%, or from about 0.1 to about 1% by weight of the final detergent composition.

Particulate Material Other than Crystalline Structurants

The detergent compositions herein may further include particulate material such as suds suppressors, encapsulated sensitive ingredients, e.g., perfumes, bleaches and enzymes in encapsulated form; or aesthetic adjuncts such as pearlescent agents, pigment particles, mica or the like. Suitable use levels are from about 0.0001% to about 5%, or from about 0.1% to about 1% by weight of the final detergent composition. In embodiments of the invention it is found useful to incorporate certain particulate materials, e.g., mica for visual appearance benefits, directly into the crystalline structurant premix while formulating more sensitive particulate materials, e.g., encapsulated enzymes and/or bleaches, at a later point into the final detergent composition.

In one embodiment, the liquid detergent composition comprises a perfume. Perfume is typical incorporated in the present compositions at a level of at least about 0.001%, preferably at least about 0.01%, more preferably at least about 0.1%, and no greater than about 10%, preferably no greater than about 5%, more preferably no greater than about 3%, by weight.

In one embodiment, the perfume of the fabric conditioning composition of the present invention comprises an enduring perfume ingredient(s) that have a boiling point of about 250° C. or higher and a C log P of about 3.0 or higher, more preferably at a level of at least about 25%, by weight of the perfume. Suitable perfumes, perfume ingredients, and perfume carriers are described in U.S. Pat. No. 5,500,138; and US 20020035053 A1.

In another embodiment, the perfume comprises a perfume microcapsule and/or a perfume nanocapsule. Suitable perfume microcapsules and perfume nanocapsules include those described in the following references: US 2003215417 A1; US 2003216488 A1; US 2003158344 A1; US 2003165692 A1; US 2004071742 A1; US 2004071746 A1; US 2004072719 A1; US 2004072720 A1; EP 1393706 A1; US 2003203829 A1; US 2003195133 A1; US 2004087477 A1; US 20040106536 A1; U.S. Pat. No. 6,645,479; U.S. Pat. No. 6,200,949; U.S. Pat. No. 4,882,220; U.S. Pat. No. 4,917,920; U.S. Pat. No. 4,514,461; U.S. RE 32713; U.S. Pat. No. 4,234,627.

In yet another embodiment, the liquid detergent composition comprises odor control agents such as described in U.S. Pat. No. 5,942,217: "Uncomplexed cyclodextrin compositions for odor control", granted Aug. 24, 1999. Other agents suitable odor control agents include those described in: U.S. Pat. No. 5,968,404, U.S. Pat. No. 5,955,093; U.S. Pat. No. 6,106,738; U.S. Pat. No. 5,942,217; and U.S. Pat. No. 6,033,679.

Hydrotropes

The liquid detergent compositions optionally comprises a hydrotrope in an effective amount, i.e. from about 0% to 15%, or about 1% to 10%, or about 3% or about 6%, so that the liquid detergent compositions are compatible in water. Suitable hydrotropes for use herein include anionic-type hydrotropes, particularly sodium, potassium, and ammonium xylene sulfonate, sodium, potassium and ammonium toluene sulfonate, sodium potassium and ammonium cumene sulfonate, and mixtures thereof, as disclosed in U.S. Pat. No. 3,915,903.

Polymers Other than the Coupling Polymer

Compositions of the present invention can further include, at their usual levels, low levels of perfume deposition enhancing polymers such as unsubstituted polyalkyleneimines; dye transfer inhibiting polymers such as PVP or PVP/VI at levels of e.g., from about 0.0001% to about 1%, suds suppressors, including polymeric silicone types or mixtures thereof with various silicas at levels of from about 0.001% to about 2%, soil release polymers such as substituted or unsubstituted, capped or uncapped polyethylene terephthalates at levels of from about 0.01% to about 5%, silicone fabric care polymers such as aminofunctional silicones at levels of from about 0.01% to about 3%. and sulfocarboxylate polymers such as those known in the art as builders. Other useful but optional polymers include PEG/Vinyl acrylate copolymers, which can be formulated as suspensions, or otherwise known cleaning polymers comprising nitrogen and having combinations of ethoxylate and/or propoxylate moieties.

Packaging

Test Methods

Viscosity is measured using an AR-G2 Rheometer from TA Instruments (New Castle, Del., USA). Viscosity is measured at 21° C. and is plotted as a function of shear rate.

Phase Split

Recall first that in one aspect the invention relates to a process for manufacturing a concentrated aqueous liquid or gel-form laundry detergent comprising at least 10% of at least one anionic nonsoap surfactant; at least 0.1% of other surfactants such that the total surfactant level is at least 20% by weight of said detergent; and no more than 15% organic nonaminofunctional solvent by weight of said detergent; said process comprising in any order (i) at least one step of formulating said detergent with an alkanolamine; (ii) at least one step of formulating said detergent with a coupling polymer; and (iii) at least one step of formulating said detergent with a laundering adjunct selected from detergent-active enzymes, textile optical brighteners and fabric-hueing dyes; and that a preferred process further comprises a step (iv) in any order with respect to steps (i), (ii) and (iii) of formulating into said detergent from 0.05% to 2%, by weight of said detergent, of a crystalline structurant.

According to the present test method for phase splits, i.e., phase stability.

The phase stability of the detergent compositions is evaluated by placing 300 ml thereof in a transparent glass jar e.g., a laboratory beaker of capacity 500 ml, for 21 days at 21° C. The detergent is stable to phase splits if, within said time period, (i) it remains free from splitting into two or more layers or, (ii) if the detergent splits into layers, a major layer comprising at least 90%, preferably 95%, by weight of the composition is present. Inventive detergent product (Example 1-5) does not split under the test conditions.

Conductivity as a Measure of Dissolution Speed at Low Temperature

The following is a beaker test conducted at low agitation speed and at a temperature of 20° C. to mimic the cold water/wool cycle in an automatic washing machine. The test measures rate of dissolution of the concentrated liquid or gel laundry detergent by following the evolution of conductivity with time. Equipment: magnetic hot plate, conductivity meter, stopwatch.

Procedure:

- Take a 3 L beaker (H=20 cm, ø=15 cm), fill it with 2500 gram demineralized water and place in the beaker a cylindrical magnetic stirrer bar of 7×1 cm.
- Put the beaker on a magnetic hot plate (type RCT basic from IKA® WERKE). Set the speed to setting "6", but do not turn the device on yet.
- Add 7.115 ml of laundry product, by means of a pipette, to the water. (7.115 ml in 2.5 l water corresponds with 37 ml in 13 L water, i.e., in line with concentration of laundry detergent to be used in an automatic washing machine).
- Secure the probe of the conductivity meter (type Consort K911) vertically in the water—bottom of the probe is 3 cm below the water surface.
- At the same time, switch on the magnetic hot plate and a stopwatch.
- Measure time evolution of conductivity.

Remarks: The test is not limited to the mentioned settings: one might change the temperature of the water or the speed of mixing, so as to model other washing conditions. This is a comparative test and not an absolute one.

Learnings:

All the inventive laundry detergent compositions (Examples 1-5) achieve 50% dissolution in less than 25 sec.

By way of comparison, commercial concentrated liquid or gel-type detergent products such as "Ultra gel" as marketed by Co-op in the UK in May 2009, or such as "Biological gel" as marketed by Marks and Spencer in the UK in May 2009, take about 1 min.

Residue on Fabric (Black Pouch Test)

Take a piece of black velvet (roughly 20×30 cm) and fold it in two, with the soft part on the outside. (a velvet fabric typically is rather flat on one side and softer/fluffier on the other side)

Sew 2 sides tightly together, and leave 1 side open—you have now created a pouch.

Pour 37 ml of inventive liquid laundry detergent or a recommended dose of a comparative product available on the market (follow the dosage instructions) into a dosing device (a suitable dosing device is marketed with Ariel Excel Gel) and place the dosing device inside the black pouch.

Stitch the remaining side tightly together; the dosing device is now completely trapped inside the pouch.

Place the pouch in a front-loading domestic automatic clothes washing machine (suitable model is Miele 526 without adding any laundry.

Run a wool cycle at 40° C.

After the wash/rinse take out the black pouch.

Cut it open with a pair of scissors and let it dry on the bench.

Record occurrence of residues when the fabric is dry.

Analysis of the Black Pouch After Testing:

1) no residues: OK (applies to inventive laundry detergents herein, see Examples 1-5).

2) at least some residues: not OK (applies to comparative laundry detergents not in accordance with the invention such as the "gels" from Co-op and Marks and Spencer mentioned above).

Examples

Referencing Table I, the non-limiting examples disclosed therein include those that are illustrative of several embodiments of the invention.

Example 1 is an example of a liquid detergent composition according to the invention, wherein a premix comprising 4% HCO, 16% Linear Alkyl Benzene Sulfonic acid neutralized by 1.9% NaOH and water up to 100 parts is made and then added at 18.75% level in a laundry detergent matrix comprising the rest of the ingredients, to give the detergent composition 1 in Table I.

Example 2 is an example of a liquid detergent composition according to the invention, wherein a premix comprising 4% HCO, 16% Linear Alkylbenzene Sulfonic acid neutralized by 3.1% Monoethanolamine (MEA), and water up to 100 parts is made and then added at 18.75% in a laundry detergent matrix comprising the rest of the ingredients, to give the detergent composition 2 in Table I.

Examples 3-5 are examples of liquid detergent compositions according to the invention, using the same HCO premix with MEA neutralized Linear Alkylbenzene Sulfonic acid as in Example 2, added at the same level (18.75%) to the rest of the ingredients.

TABLE I

| Example Number | 1 | 2 | 3 | 4 | 5 |
|---|---|---|---|---|---|
| Ingredient Weight Percentage | % | % | % | % | % |
| Linear Alkylbenzene sulfonic acid[1] | 15 | 15 | 12 | 12 | 11 |
| C12-14 alkyl ethoxy 3 sulfate MEA salt | 10 | 10 | 8 | 9 | 8.5 |
| C12-14 alkyl 7-ethoxylate | 10 | 10 | 8 | 8 | 7.5 |
| C12-18 Fatty acid | 10 | 10 | 10 | 10 | 9.5 |
| Citric acid | 2 | 2 | 3 | 3 | 3 |
| Coupling polymer: Ethoxysulfated Hexamethylene Diamine Dimethyl Quat* | — | 3 | — | 2.2 | 2.2 |
| Coupling polymer: Alkoxylated Polyalkylenimine Polymer[2] | 3 | — | 2.2 | — | — |
| Non-coupling cleaning polymer: PEG-PVAc Polymer[3] | — | — | 1.3 | 0.9 | 0.8 |
| Chelant: Hydroxyethane diphosphonic acid | 1.6 | 1.6 | 1.6 | 0 | 1.6 |
| Fluorescent Whitening Agent 49 | 0.2 | 0.2 | 0.2 | 0.2 | 0.2 |
| Non-aminofunctional solvent: 1,2 Propanediol | 6.2 | 6.2 | 8.5 | 8.5 | 6.0 |
| Non-aminofunctional solvent: Ethanol | 1.5 | 1.5 | — | — | — |
| Non-aminofunctional solvent: Diethylene Glycol | 1.5 | 1.5 | — | — | 4.0 |
| Crystalline Structurant: Hydrogenated castor oil | 0.75 (introduced via NaLAS premix) | 0.75 (introduced via MEA LAS premix) | | | |
| Boric acid | 0.5 | 0.5 | 0.5 | — | — |
| Calcium Chloride | 0.03 | 0.03 | 0.03 | 0.06 | 0.06 |
| Potassium bisulfite | — | — | 0.3 | 0.3 | — |
| Perfume | 1.7 | 1.7 | 1.7 | 1.7 | 1.7 |
| Alkanolamine: (MEA or MEA/TIPA at 5:1 weight ratio) | To pH 8.0 (in the case of Example 5, this corresponds to 8.1% MEA not including MEA coming from other sources e.g., MEA salt of surfactant. Typical level of alkanolamine is about 9%) | | | | |
| Protease enzyme FNA (40.6 mg/g) | 1.5 | 1.5 | 1.5 | 1.5 | 1.5 |
| Amylase enzyme Termamyl Ultra (25.1 mg/g) | 0.1 | 0.1 | 0.8 | 0.1 | |
| Mannanase enzyme (25 mg/g) | 0.1 | 0.1 | 0.1 | 0.1 | |
| Cellulase enzyme (25 mg/g) | — | — | 0.1 | 0.1 | |

TABLE I-continued

| Example Number | 1 | 2 | 3 | 4 | 5 |
|---|---|---|---|---|---|
| Xyloglucanase enzyme (20 mg/g) | — | — | 0.1 | 0.1 | |
| Pectate lyase enzyme (20 mg/g) | — | — | 0.1 | 0.1 | |
| Water and minors e.g., antifoam, dyes | | | To 100 parts | | |

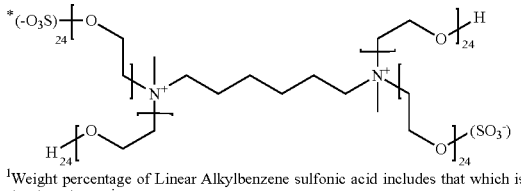

[1]Weight percentage of Linear Alkylbenzene sulfonic acid includes that which is added to the composition via the hydrogenated castor oil structurant premix

[2]600 g/mol molecular weight polyethylenimine core with 20 ethoxylate groups per —NH.

[3]PEG-PVA graft copolymer is a polyvinyl acetate grafted polyethylene oxide copolymer having a polyethylene oxide backbone and multiple polyvinyl acetate side chains. The molecular weight of the polyethylene oxide backbone is about 6000 and the weight ratio of the polyethylene oxide to polyvinyl acetate is about 40 to 60 and no more than 1 grafting point per 50 ethylene oxide units.

The liquid detergent compositions made according to the examples may be packaged into inverted squeezable bottles with slit valves.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

Every document cited herein, including any cross referenced or related patent or application, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A process for manufacturing a concentrated aqueous liquid or gel-form laundry detergent comprising the steps of:

(i) providing a crystalline structurant premix, wherein said premix comprises from about 2% to about 10%, by weight of said premix, of a crystalline structurant, from about 2% to about 10%, by weight of said premix, of an alkanolamine, and from about 5% to about 50%, by weight of said premix, of an anionic nonsoap surfactant and, a liquid carrier, wherein said premix is substantially free from monovalent and/or divalent inorganic metal ions, wherein the making of said premix comprises emulsifying and then crystallizing said structurant;

(ii) adding said premix to a laundry detergent composition, comprising a coupling polymer at a level of from 0.1% to 5% by weight of the laundry detergent, at least 10% by weight of the laundry detergent composition of anionic nonsoap surfactant, at least 0.1% of other surfactants such that the total surfactant level is at least 20% by weight of said detergent composition, no more than 15% by weight of said detergent composition of an organic non-amino functional solvent, and a laundry adjunct selected from the group consisting of detergent active enzymes, textile optical brighteners, fabric hueing dyes, and mixtures thereof, wherein said premix is added to said laundry detergent composition in an amount sufficient to provide from 0.05% to 2%, by weight of said detergent, of said crystalline structurant, and wherein said crystalline structurant comprises hydrogenated castor oil.

2. The process according to claim 1, wherein the premix further comprises a preservative.

3. The process according to claim 1, wherein the solvent is selected from the group consisting of ethanol, propanol, butanol, isopropanol, 1,2-propanediol, 1,3-propanediol, diethylene glycol, and mixtures thereof.

4. The process according to claim 1, wherein the alkanolamine is selected from the group consisting of monoethanolamine, diethanolamine, triethanolamine, triisopropanolamine, and mixtures thereof.

5. The process according to claim 1, wherein the liquid carrier in the premix is selected from the group consisting of water, organic non-aminofunctional solvent, and mixtures thereof.

6. The process according to claim 5, wherein the liquid carrier comprises water at levels of from 5% to 90% by weight of the premix.

7. The process according to claim 1 wherein said coupling polymer comprises water-soluble, polar amphiphilic copolymers having an aliphatic backbone comprising at least two nitrogen atoms to which backbone are connected at least two side-chains comprising poly(ethoxylate) moieties.

8. The process according to claim 1, wherein the anionic nonsoap surfactant is introduced into the crystalline structurant premix as preneutralized by the alkanolamine.

9. The process according to claim 1, wherein the hydrogenated castor oil is processed in a starting form selected from solid, molten, and mixtures thereof.

10. The process according to claim 1, wherein the premix is added to said laundry detergent composition in an amount sufficient to provide from from 0.1% to 0.8%, by weight of said detergent, of said hydrogenated castor oil.

11. The process according to claim 1, wherein the premix comprises from about 3% to about 8%, by weight of the premix, hydrogenated castor oil.

12. The process according to claim 1, wherein the premix comprises from about 4% to about 6%, by weight of the premix, hydrogenated castor oil.

13. The process according to claim 1, wherein the laundry detergent is phase stable after being stored for 21 days at 21° C.

* * * * *